US006257321B1

(12) United States Patent
Watson et al.

(10) Patent No.: US 6,257,321 B1
(45) Date of Patent: Jul. 10, 2001

(54) HIGH PRODUCTION CHILL ROLL

(75) Inventors: Carter H. Watson, Foley; Allan A. Whillock, Mobile, both of AL (US); Charles E. Gibbons, Cincy, OH (US)

(73) Assignee: International Paper Company, Tuxedo Park, NY (US)

( * ) Notice: Subject to any disclaimer, the term of this patent is extended or adjusted under 35 U.S.C. 154(b) by 0 days.

(21) Appl. No.: 09/320,658

(22) Filed: May 27, 1999

Related U.S. Application Data

(62) Division of application No. 08/706,024, filed on Aug. 30, 1996, now Pat. No. 5,983,993.

(51) Int. Cl.[7] ..... F28D 11/02

(52) U.S. Cl. ..... 165/90; 165/89; 492/44; 492/46

(58) Field of Search ..... 165/89, 90; 492/44, 492/46

(56) References Cited

U.S. PATENT DOCUMENTS

| | | | | |
|---|---|---|---|---|
| Re. 30,302 | * | 6/1980 | Stamislaw | 165/89 |
| 4,453,593 | * | 6/1984 | Barthel et al. | 165/89 |
| 5,078,204 | * | 1/1992 | Loffredo et al. | 165/89 |

FOREIGN PATENT DOCUMENTS

| | | | | |
|---|---|---|---|---|
| 406182896 | * | 7/1994 | (JP) | 492/46 |

* cited by examiner

*Primary Examiner*—Christopher Atkinson
(74) *Attorney, Agent, or Firm*—Hoffman, Wasson & Gitler; Michael J. Doyle

(57) ABSTRACT

A chill roll for cooling a web is provided and includes a cylindrical outer roll having an inner and an outer surface, the inner surface of the outer roll having circumferential projections spaced at intervals along its length forming circumferential channels therebetween. The chill roll further has a cylindrical inner roll having an inner and an outer surface, and a diameter less than a diameter of the outer cylindrical roll and defining an annular space between the outer surface of the cylindrical inner roll and the inner surface of the cylindrical outer roll, allowing a coolant material to flow into and out of the circumferential channels and to contact the inner surface of the cylindrical outer roll to uniformly cool the outer surface of the cylindrical outer roll. A cylindrical middle shell is disposed between the inner surface of the cylindrical outer roll and the outer surface of the cylindrical inner roll allowing passage of the coolant material from the cylindrical inner roll to be transferred into and out of the circumferential channels through openings disposed along the cylindrical middle shell.

15 Claims, 11 Drawing Sheets

HIGH PRODUCTION CHILL ROLL

This is a divisional of application Ser. No. 08/706,024, filed Aug. 30, 1996 now U.S. Pat. No. 5,983,993.

BACKGROUND OF THE INVENTION

1. Field of the Invention

The present invention relates to a high production chill roll. More particularly, the present invention relates to a chill roll for cooling a web of material in the extrusion coating of paper and plastic film extrusion. The chill roll permits production rates which are higher than previously attainable by reducing the retention of heat in the outer shell of the chill roll. Furthermore, the chill roll of the present invention distributes coolant material throughout the inside of the chill roll to achieve uniform cooling across the surface of the chill roll.

2. Description of the Prior Art

Conventional chill rolls are used, in the formation of rolls of plastic and paper-based products, to cool the web of material passing around the surface of the chill roll. Commonly, water is passed through hollow cylinders, as the web of material passes around it. The production capacity of a chill roll is determined by a number of factors, including but not limited to: the diameter of the chill roll, the speed of rotation, the thickness of the outer surface of the roll, the effectiveness of the coolant material, and the uniformity of the cooling of the chill roll surface.

In most chill rolls water enters one end of the roll and exits the opposite end. As the water moves along the length of the chill roll it draws heat from the web of material traveling around the chill roll. Consequently, the side of the web closest to the water inlet is cooled to a much higher degree than the side of the web nearest the water exit. Such a temperature gradient across the chill roll lowers the production capacity of the system or produces inferior quality products.

Extrusion coating for applying plastic to paper requires chill rolls, or some means, to produce larger cooling capacity per unit area. The higher cooling capacity is due to the fact that plastic coatings, such as polyethylene, must be cooled to a temperature close to room temperature before it can be stripped from the chill roll. Furthermore, the diameter of the chill roll can not be so large that it creates a displacement of the extrusion die too far from a combining nip, which would cause a loss of coating adhesion, excessive neck-in of the coating, and other difficulties.

While the thickness of the outer shell of the chill roll can be made thinner to assist in the cooling of the web of material, such a reduction brings with it a reduction in the strength of the chill roll. At high speeds and high nip loads such a roll breaks down upon itself.

SUMMARY OF THE INVENTION

These and other deficiencies of the prior art are addressed by the present invention which is directed to a chill roll for cooling a web and includes a cylindrical outer roll having an inner and an outer surface, the inner surface of the outer roll having circumferential or helical structural projections spaced along its length forming circumferential or helical channels therebetween. The chill roll further has a cylindrical inner roll having an inner and an outer surface, and a diameter less than a diameter of the outer roll and may define an annular space between the outer surface of the inner roll and the inner surface of the outer roll, allowing a coolant material to flow into and out of the circumferential channels and to contact the inner surface of the outer roll to uniformly cool the outer surface of the outer roll. Alternately, the outer surface of the cylindrical inner roll may abut the structural projections.

A cylindrical middle shell may be disposed between the inner surface of the outer roll and the outer surface of the inner roll allowing passage of the cooling medium from the inner roll to be transferred into and out of the circumferential or helical channels through openings located along the middle shell. The middle shell allows the pressure distribution of the cooling medium to be profiled.

Based on the foregoing, it is an object of the present invention to provide a chill roll which develops even longitudinal cooling.

Another object of the present invention is to provide a chill roll which can operate at higher speeds without creating a decrease in the effectiveness of the cooling operation.

Still another object of the present invention is to provide a chill roll which has a greater inner surface area thereby increasing the heat transfer between the web and the cooling medium.

Yet another object of the present invention is to provide a chill roll which sufficiently cools the web of material without significantly increasing the diameter of the chill roll.

Another object of the present invention is to provide a chill roll having a unique design to distribute the cooling material throughout the chill roll.

BRIEF DESCRIPTION OF THE DRAWINGS

These and other objects and attributes of the present invention will be described with respect to the following drawings in which.

DETAILED DESCRIPTION OF THE INVENTION

Figure 1:
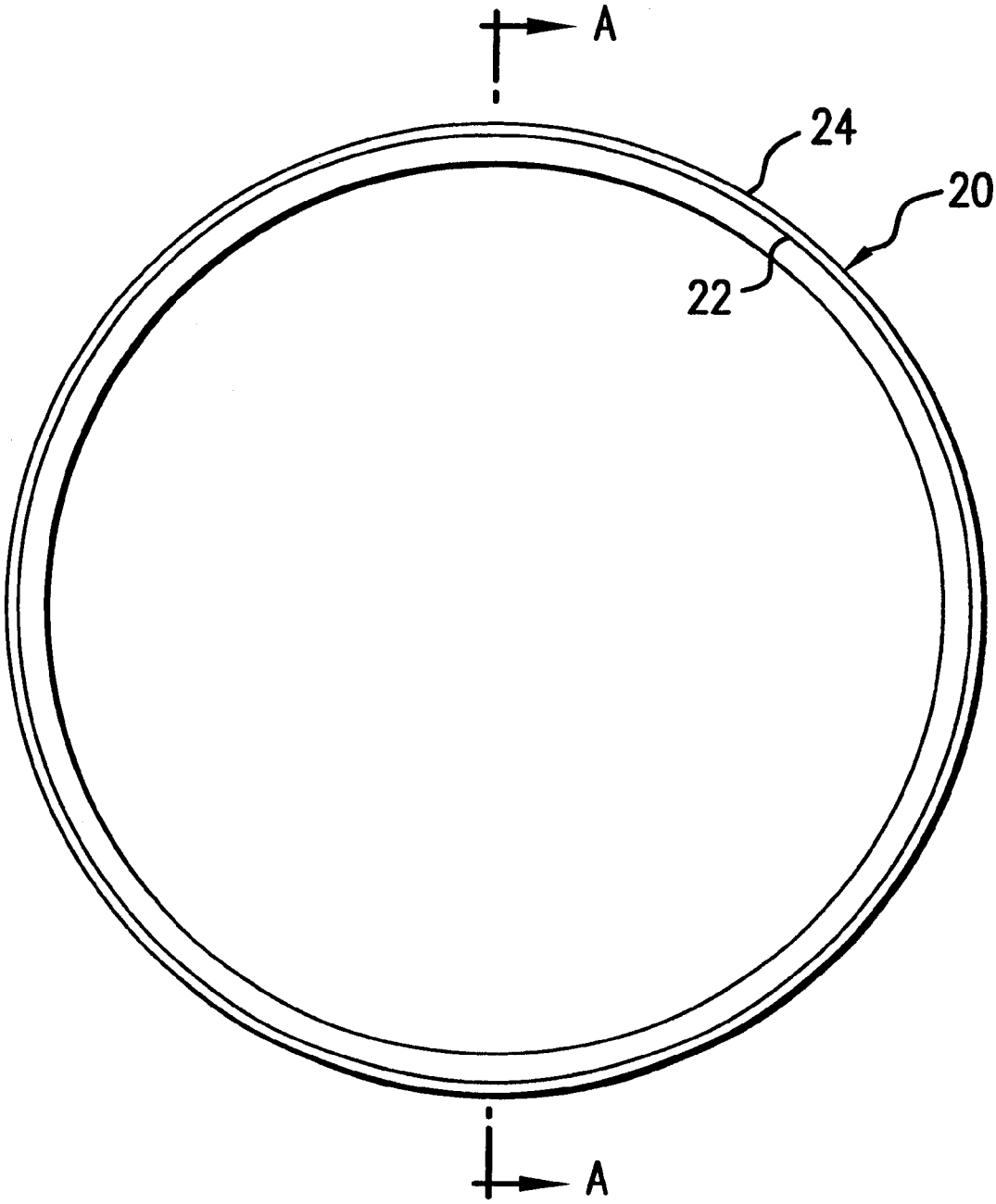
FIG. 1 is a front face view of the outer cylindrical roll embodying the invention.
Figure 2:
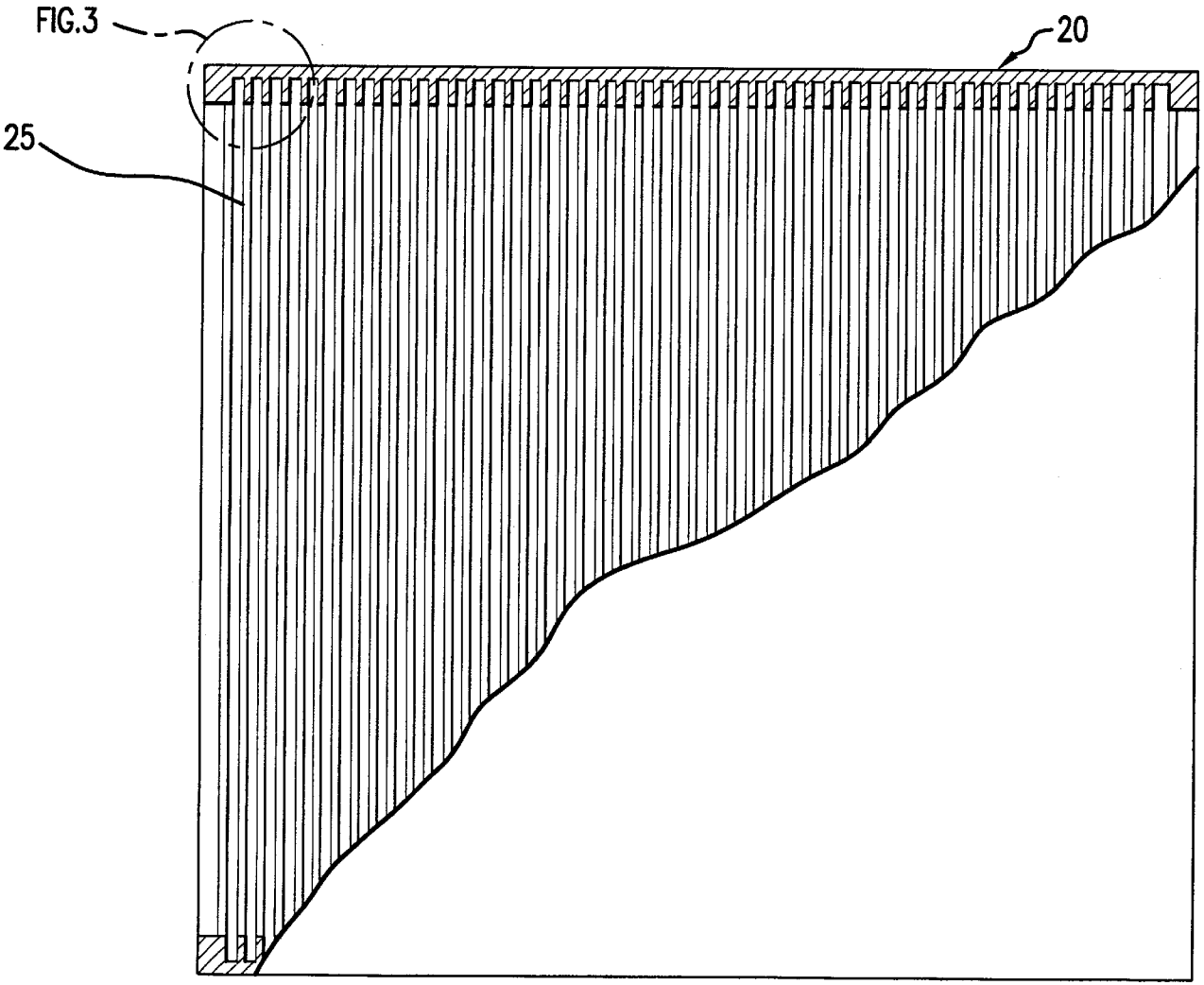
FIG. 2 is a cross-sectional view taken along line A—A of FIG. 1 of the outer cylindrical roll embodying the invention.
Figure 3:
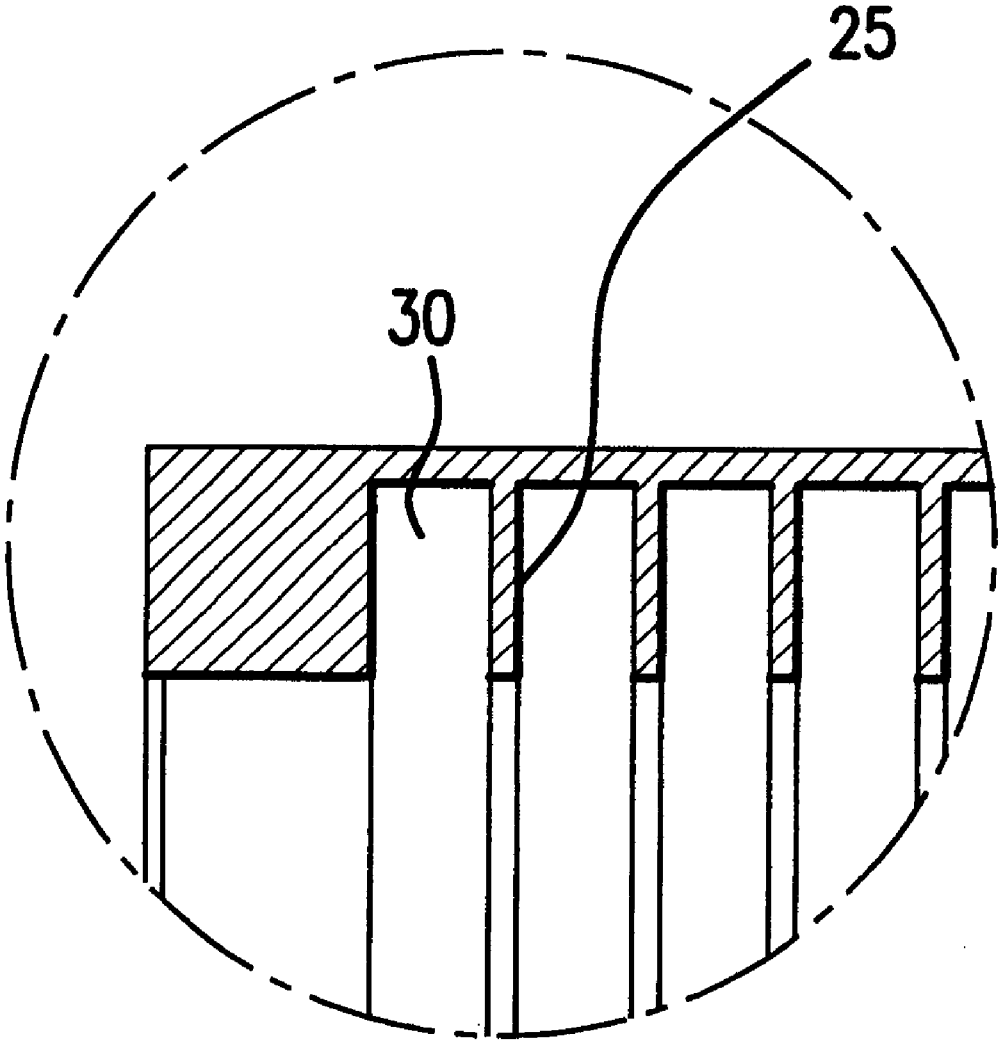
FIG. 3 is a blown up sectional detail from FIG. 2 of the outer cylindrical roll embodying the invention.
Figure 4:
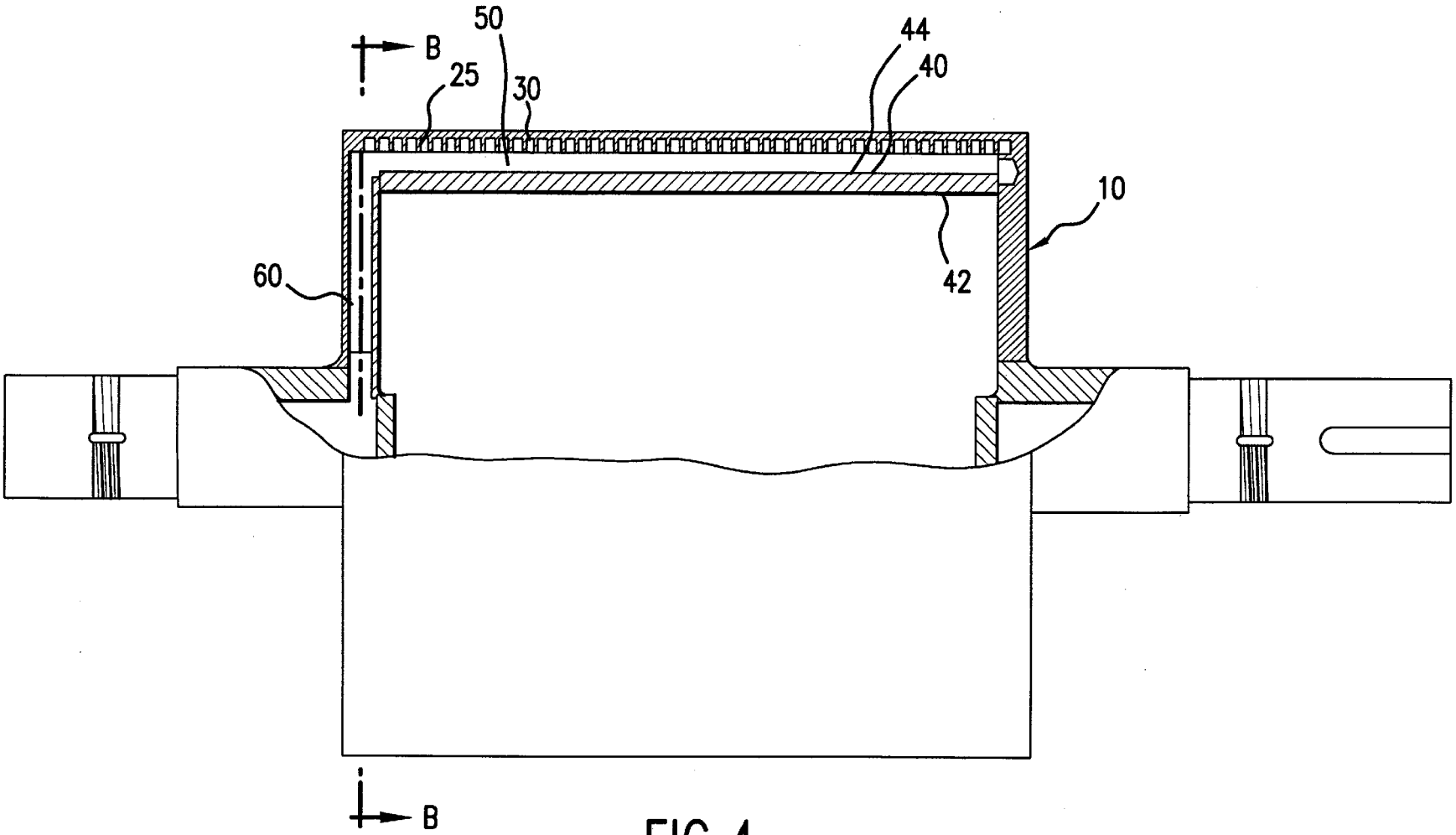
FIG. 4 is a side sectional view of the chill roll embodying the invention.

FIGS. 1–3 show an cylindrical outer roll 20 according to the present invention, and which forms a part of the chill roll 10 shown in FIG. 4. The cylindrical outer roll 20 has an inner surface 22 and an outer surface 24 with a thickness in the range of 0.025" to 0.25". The diameter of the cylindrical outer roll 20 is approximately 3'. The web of material moves around the cylindrical outer roll 20 during the cooling operation, and covers a wrap angle of approximately 180–210 degrees. A web coated with polyethylene commonly must be cooled from approximately 600 degree C. to 120 degrees C., as it travels around the chill roll 10.

As shown in FIG. 2, which is a side view of the cylindrical outer roll 20 taken along line A—A of FIG. 1, and FIG. 3 the cylindrical outer roll 20 has a series of projections 25, formed on the inner surface 22, extending into the chill roll 10 creating channels 30 therebetween. The projections 25 may extend into the cylindrical outer roll 20 approximately ½", are spaced about 0.05" to about 2" apart and are approximately 0.09" thick. The projections 25 may be spaced uniformly or randomly relative to one another. The projections 25 serve two purposes. First, they increase the surface area of the cylindrical outer roll 20 which comes into contact with the coolant material, as it flows in the channels 30. Second, since the thickness of the cylindrical outer roll 20 is only about 0.025" to about 0.25", the projections 25 provide structural integrity. Thus, when the chill roll 10 is run at high speed the projections 25 prevent it from collapsing upon itself. Furthermore, the projections 25 allow the thickness of the outer roll 20 to be significantly reduced to about 0.025" to about 0.25", thereby increasing the cooling capacity.

Figure 12:
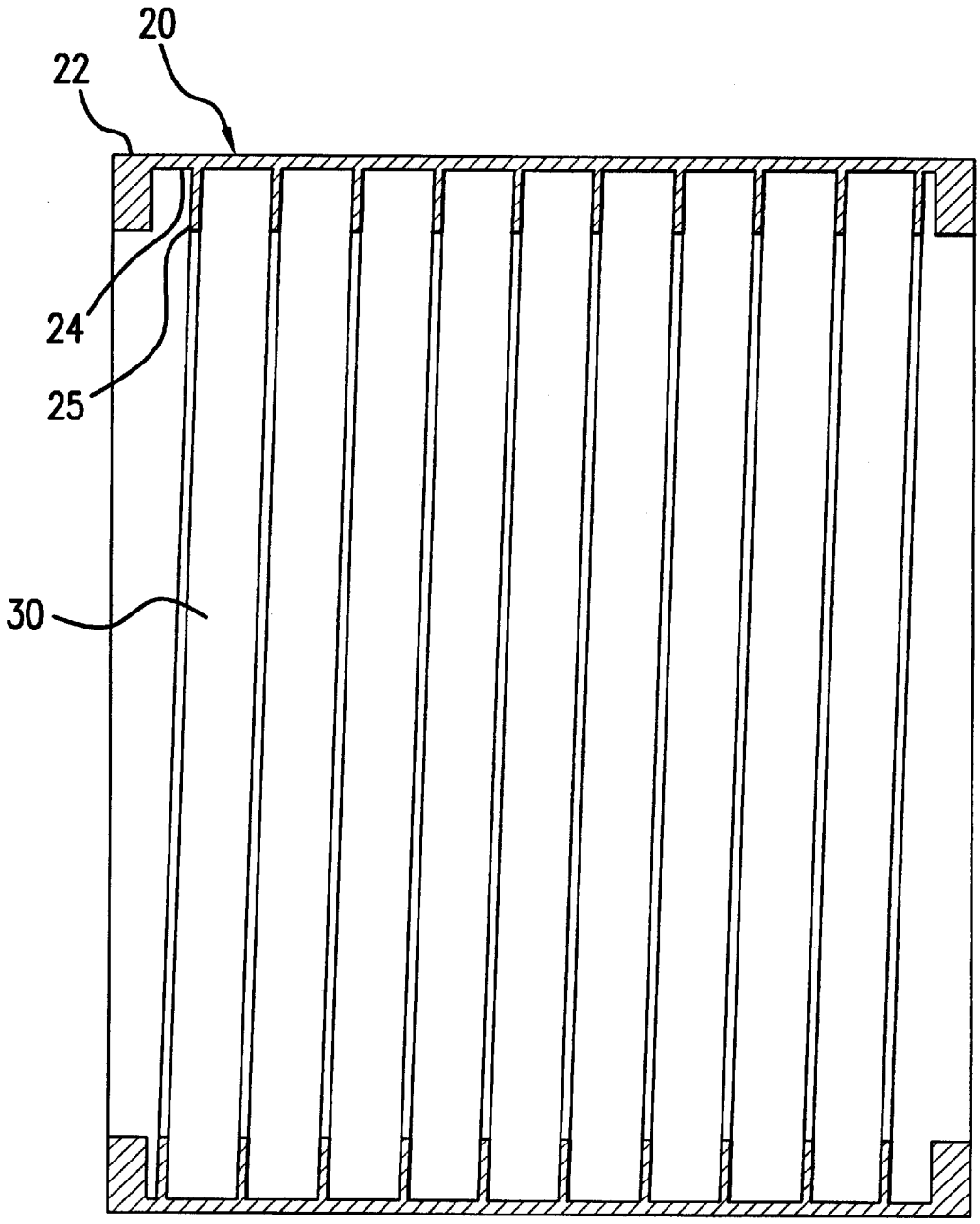
FIG. 12 is a cross-sectional view of the outer cylindrical roll showing a helical pattern of structural projections.

Although the projections 25 shown in FIGS. 2 and 3 are orthogonal to the cylindrical outer roll 20, they can be formed as triangular projections on the inner surface 22. Furthermore, while FIGS. 2 and 3 show the projections 25 in a parallel, non-intersecting rib pattern, they can be formed as a screw-type helical pattern along the length of the inner surface 22 of the cylindrical outer roll 20 as shown in FIG. 12. Such a configuration would form a single or multiple screw-type channel 30.

The outer surface 24 and/or inner surface 22 of the cylindrical outer roll 20 is plated with chrome or other surface coating to prevent corrosion, and the outer surface 24 may be roughened, as by sandblasting, to provide greater surface area in contact with the web of material. Such a sandblasted surface provides the web with a matte finish. Alternatively, the outer surface 24 of the cylindrical outer roll 20 can be smooth to provide a smooth finish on the web, or can have a combination of smooth areas and matte areas. Similarly, the inner surface 22 may be roughened or smoothed.

Figure 13:
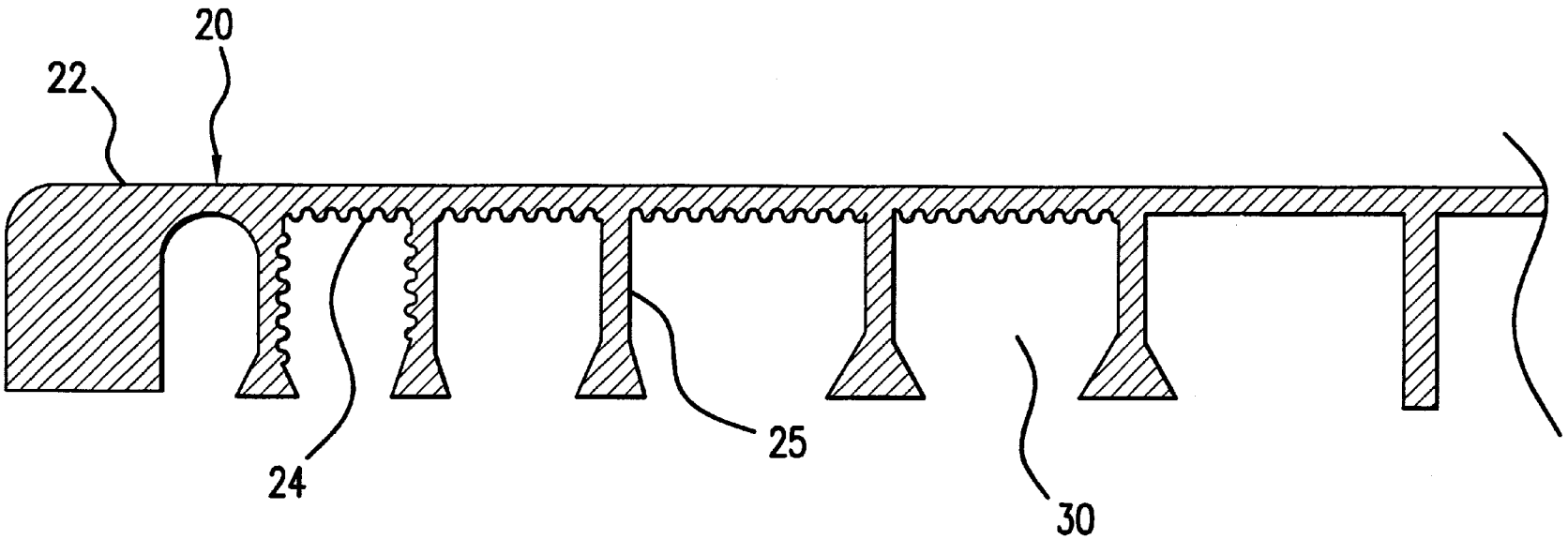
FIG. 13 is a blown up view similar to FIG. 3, showing variable shapes and spacing of the structural projections.

The projections make a thinner cylindrical outer roll 20 possible by providing increased rigidity and strength, and simultaneously increase the available surface area for heat transfer. The spacing and shape of the projections 25 can be varied as shown in FIG. 13 to allow heat transfer in a particular region to be tailored (or profiled) according to need.

Referring to FIG. 4, a side sectional view of the chill roll 10 is shown. Interior to the cylindrical outer roll 20 is a cylindrical inner roll 40 having an inner surface 42 and an outer surface 44. The diameter of the cylindrical inner roll 40 is less than the inner diameter of the cylindrical outer roll 20 to define an annular space 50 between the outer surface 42 of the cylindrical inner roll 40 and the inner surface 22 of the cylindrical outer roll 20. As will be described later, the coolant material flows in the space 50 and the channels 30 during operation of the chill roll 10.

Figure 5:
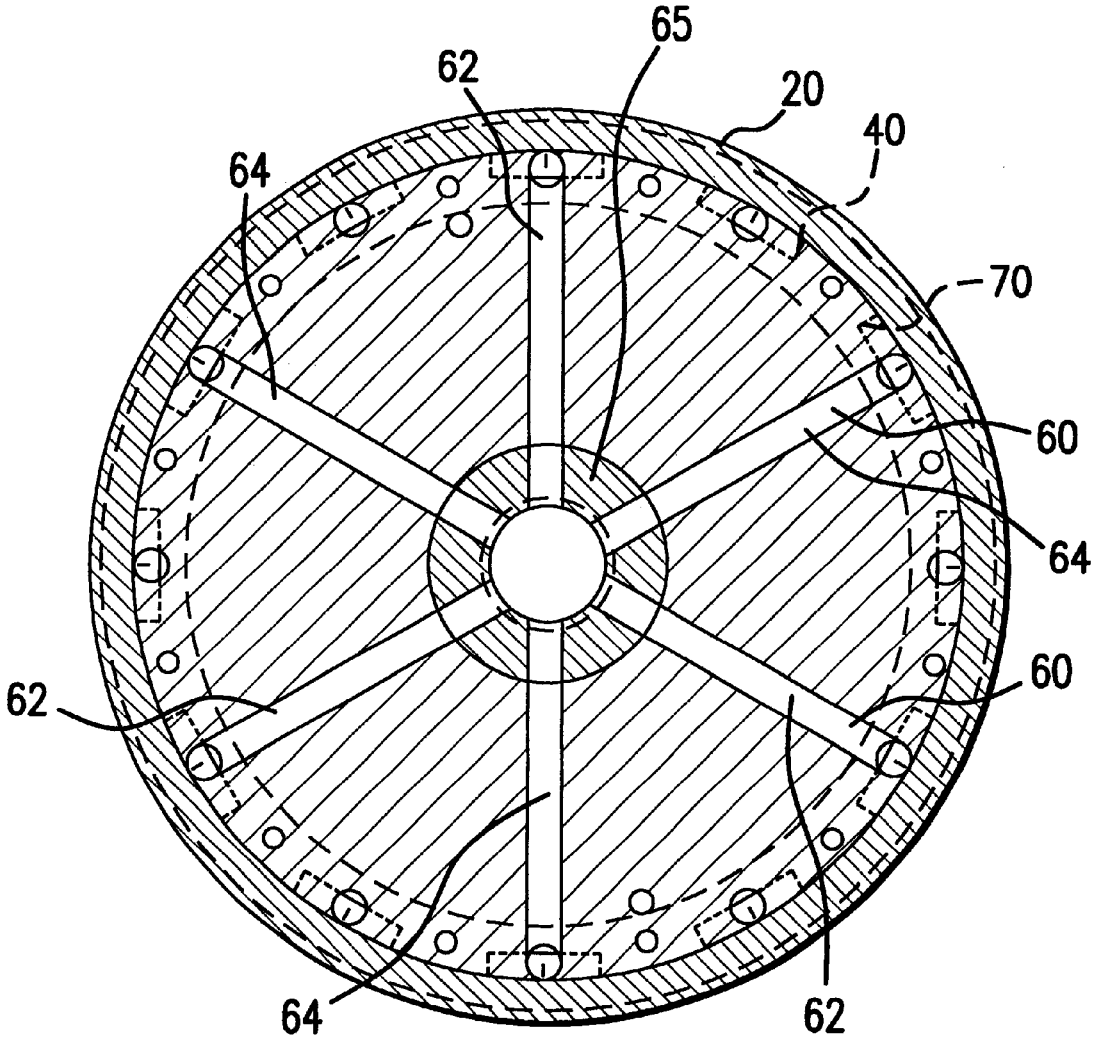
FIG. 5 is a cross-sectional view taken along line B—B of FIG. 4 of the chill roll embodying the invention.

FIG. 5 is a cross-sectional view of the chill roll 10 taken along line B—B of FIG. 4. The cylindrical inner roll 40 has multiple spokes 60 located on the hubs 65 of the cylindrical inner roll 40. Some of the spokes 60 transport coolant material from a coolant supply source to the outer surface 44 of the cylindrical inner roll 40. From there the coolant material flows into the circumferential channels 30, where heat exchange occurs, and then flows into other ones of the spokes 60 for removal. FIG. 5 shows six spokes 60 formed on hub 65. Another six spokes 60 are formed on the opposing hub 65, for a total of twelve spokes in the preferred embodiment. The spokes 60 are spaced 30 degrees apart and intake spokes 62 and out-take spokes 64 are arranged in alternating sequence. The number of spokes 60 can vary depending upon the needs of the overall system.

Figure 6:
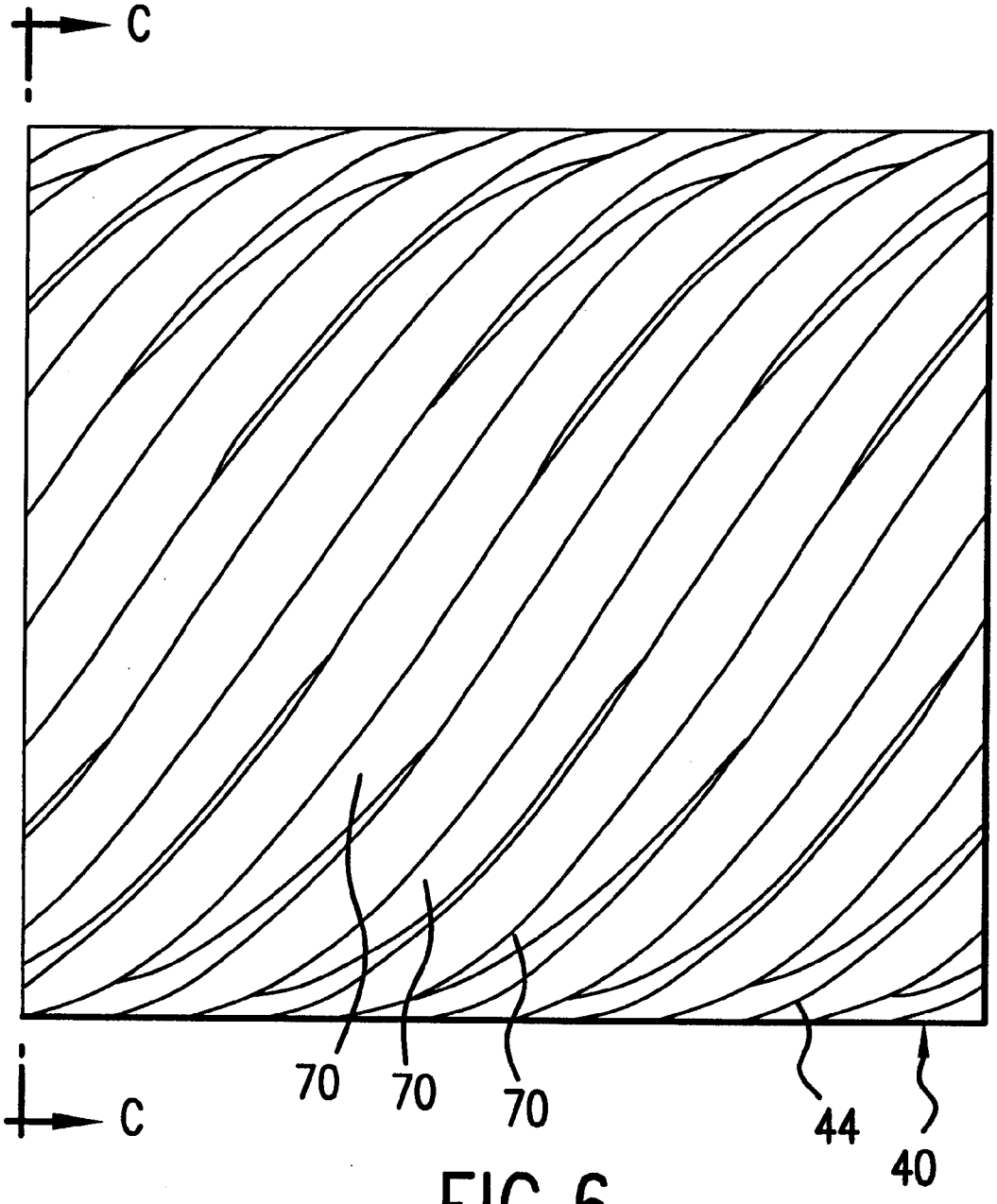
FIG. 6 is a side view of the inner cylindrical roll embodying the invention.
Figure 7:
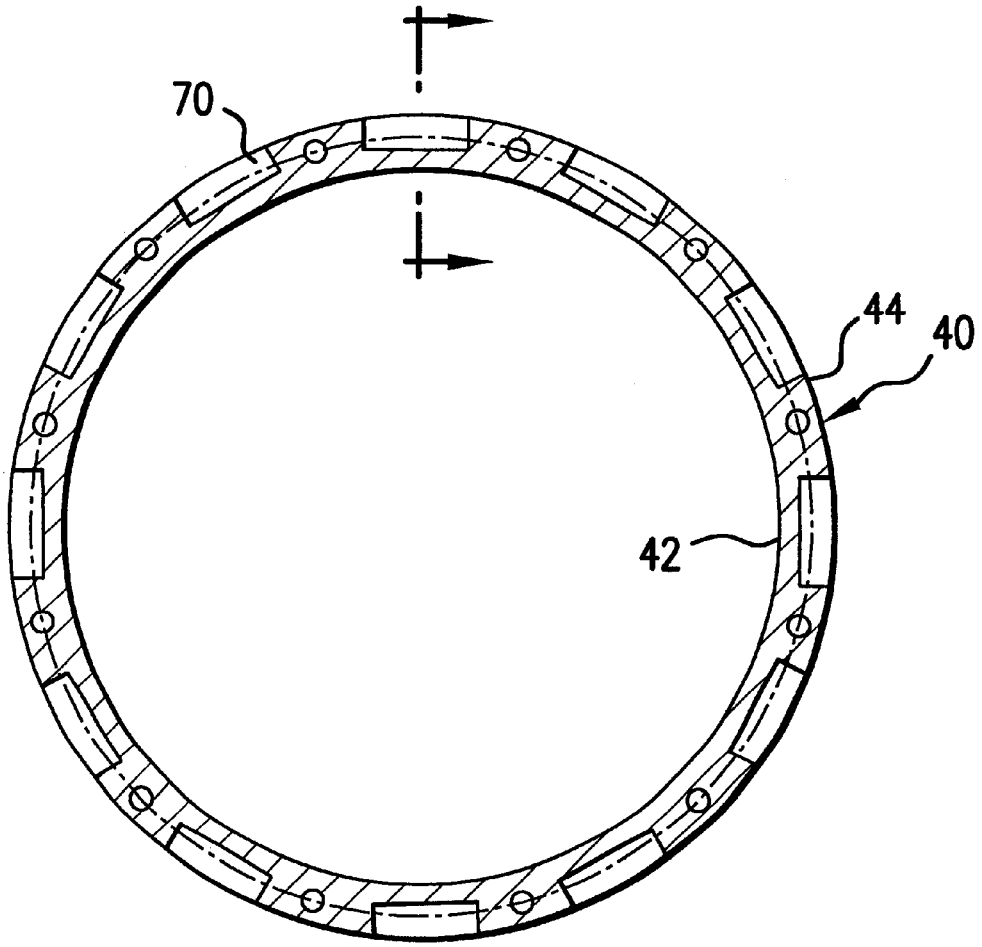
FIG. 7 is a cross-sectional view taken along line C—C of FIG. 6 of the inner cylindrical roll embodying the invention.

A side view of the cylindrical inner roll 40 is shown in FIG. 6, and a cross-sectional view of the cylindrical inner roll 40 taken along line C—C is shown in FIG. 7. These figures show that the cylindrical inner roll 40 has a series of grooves 70 formed on the outer surface 44. The grooves 70 extend along the length of the cylindrical inner roll 40 to allow the coolant material to flow into and out of the chill roll 10. Each groove 70 is approximately 4" thick. The grooves shown in FIG. 6 are formed in helical spirals around the outer surface 44 of the cylindrical inner roll 40.

Referring back to FIG. 5, the spokes 60 merge with the grooves 70 so that each groove 70 has either an intake spoke 62 or an out-take spoke 64 at an end of the groove 70. Every other one of the grooves 70 connected to the spokes 60 on one hub will deliver coolant material, while the intervening grooves 70 will withdraw coolant material.

Figure 8:
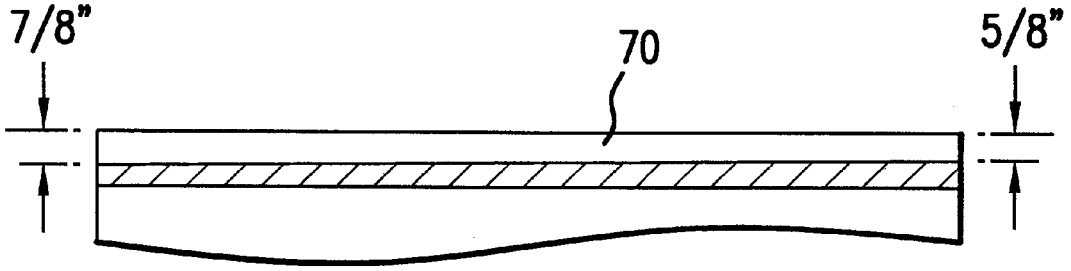
FIG. 8 is a cross-sectional view of an intake channel flattened out on the surface of an inner cylindrical roll.
Figure 10:
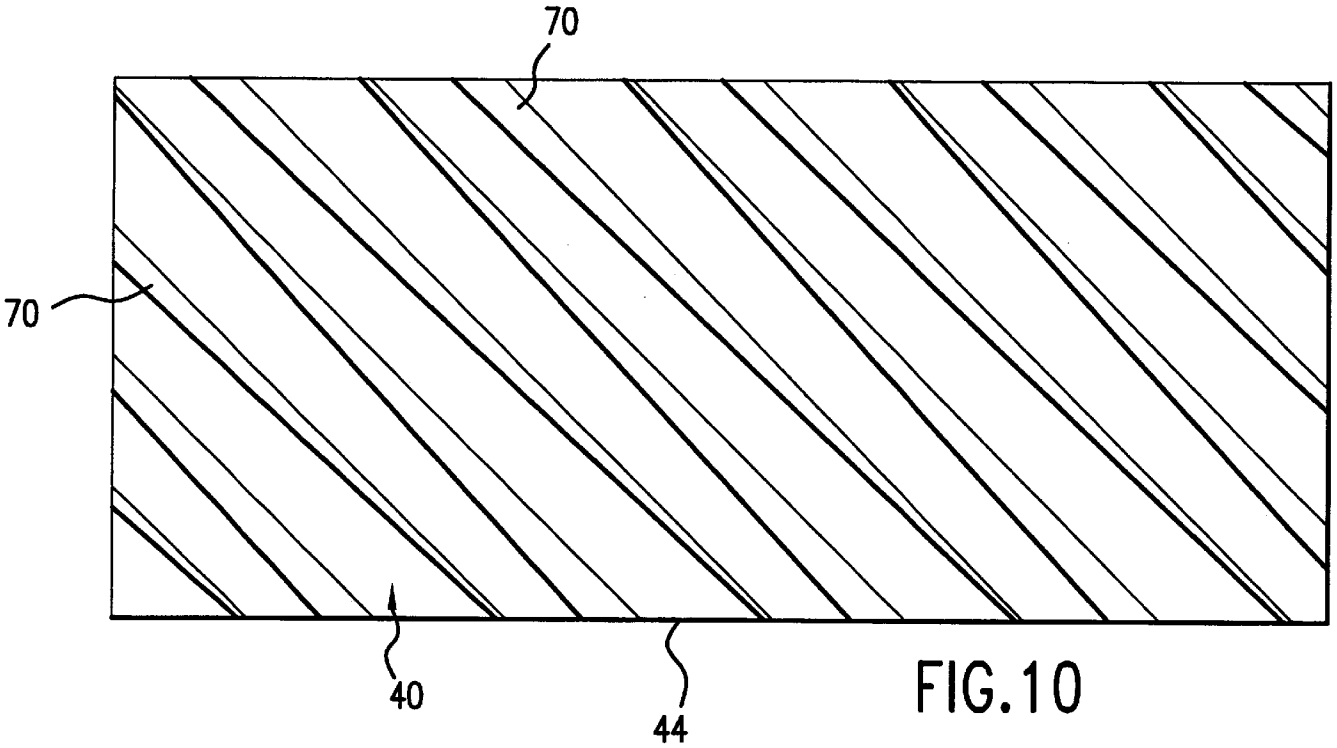
FIG. 10 is a flattened out view of an outer surface of the inner cylindrical roll embodying the invention.

FIG. 8 shows a cross-sectional view of a groove 70 on the surface of the cylindrical inner roll 40 flattened out so that detail of the depth of the groove 70 can be seen. The depth of the groove decreases along its length, from left to right, from a depth of approximately ⅞" on the left to approximately ⅝" on the right. As shown in FIG. 10 the width of the grooves 70 can be decreased and increased along their length. The depth and width are varied to provide equal pressure distribution. The depths provided are merely one example, and the depths and the amount of change in the depth will vary depending on a number of factors including, but not limited to; the cooling medium the size of the chill roll, the product being produced, and the operational speed. In the groove shown in FIG. 8, if it is a groove delivering coolant material, the coolant material flows in on the left. For grooves 70 for removing coolant the depth and/or width increases along its length.

The foregoing arrangement of spokes 60 and grooves 70 provides a flow of coolant material which originates at both ends to create uniform cooling of the chill roll 10. The change in the depth of the grooves 70 makes sure that the pressure on the coolant material remains even throughout the length of the chill roll 10.

Figure 9:
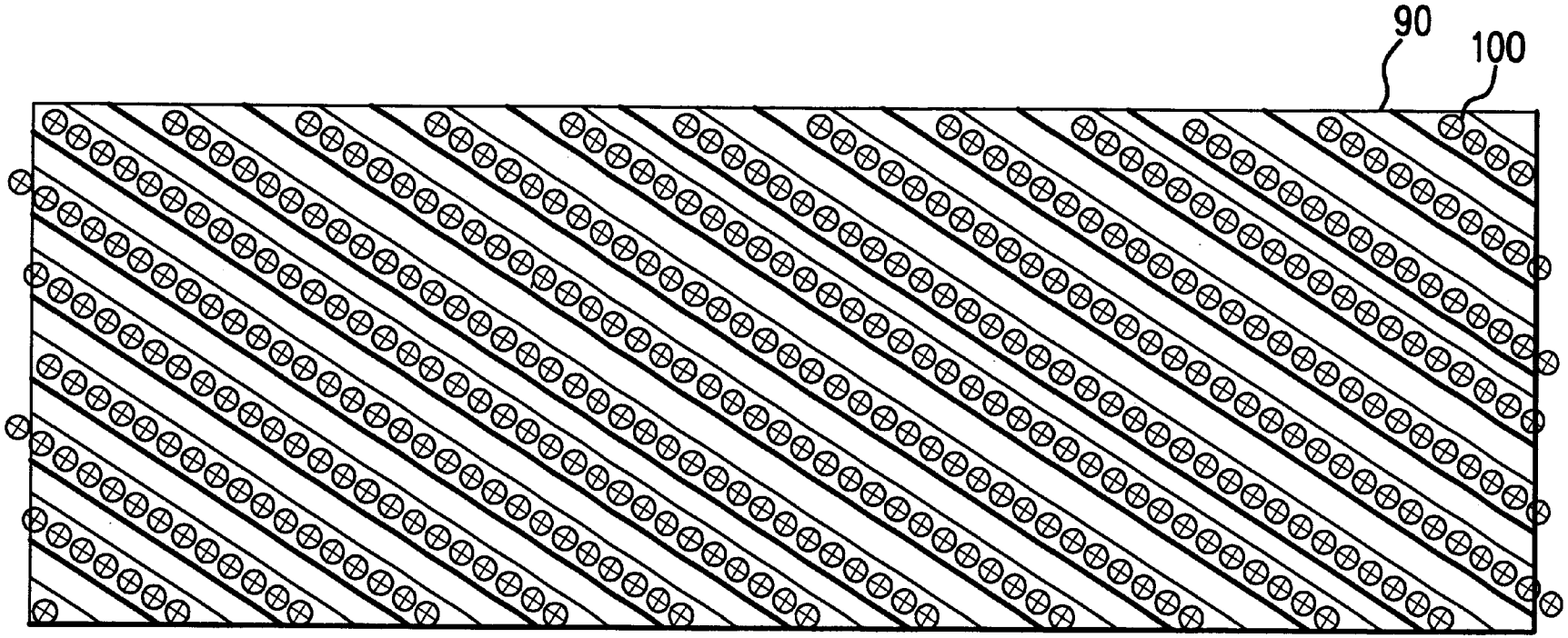
FIG. 9 is a flattened out view of a part of the middle shell of a preferred embodiment of the invention.
Figure 11:
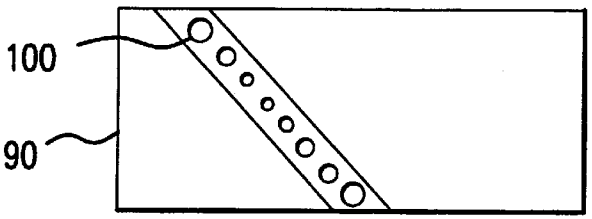
FIG. 11 is a flattened out view of an alternate embodiment of the middle shell shown in FIG. 9.

FIG. 9 shows a cylindrical middle shell 90, used in one embodiment, flattened out for illustrative purposes. The middle shell 90 is located between the outer surface 44 of the cylindrical inner roll 40 and the inner surface 22 of the cylindrical outer roll 20. The middle shell 90 has a series of openings or holes 100 formed in it to permit the flow of coolant material from the grooves 70 into the channels 25. The openings 100 can have a variety of shapes such as circular shaped, oval shaped, or a combination of circular and oval shaped. The holes do not have to have the same size, as long as the holes can be used to profile the pressure drops. Regardless of the shape of the openings 100, they preferably have a width greater than the thickness of the circumferential structural projections 25. In this way the middle shell can be positioned around the cylindrical inner roll 40 without requiring extreme precision since even if an opening 100 fell directly adjacent one of the projections 25, the coolant material could still flow out of the opening 100. Referring to FIG. 11, the size of the openings 100 can be varied along the length of the middle shell 90 to profile the pressure distribution across the chill roll 10.

A chill roll 10 constructed according to the foregoing description produced a 12.2 lbs/3000ft2 high-gloss coating weight on 265 lb./3000ft2 board that was on-machine flame treated and oven treated at a maximum line speed of 2340 feet/minute (fpm). The polyethylene stripped cleanly from chill roll 10 at speeds up to the maximum speed and the web was very stable. The maximum speed may be closer to 3000 fpm, but the line did not have a large enough extrusion capacity or linespeed capacity. A control roll was run on a conventional high-gloss chill roll and developed unacceptable defects at 1200 fpm. The upper line speed limit for this conventional chill roll appears to be approximately 1000 fpm. Thus the chill roll 10 of the present invention achieved a speed increase of 140–200%. These results would yield a production rate of 2.4 to 3.0 times current production rates.

Having described several embodiments of the chill roll in accordance with the present invention, it is believed that other modifications, variations and changes will be suggested to those skilled in the art in view of the description set forth above, such as different configurations of the structural projections, a different cross-sectional shape to the grooves, or a change in the number of spokes and grooves. It is therefor to be understood that all such variations, modifications and changes are believed to fall within the scope of the invention as defined in the appended claims.

What is claimed is:

1. A chill roll for cooling a web, comprising:

a) a cylindrical outer shell having an inner and an outer surface, said inner surface of said outer shell having structural projections spaced along a length of said cylindrical outer shell creating channels therebetween, said structural projections extending substantially orthogonally from said inner surface of said cylindrical outer shell so that portions of said inner surface of said cylindrical outer shell define a portion of said channels; and b) a cylindrical inner shell having an inner and an outer surface, wherein a diameter of said inner shell is less than a diameter of said outer cylindrical shell, allowing a coolant material to flow into and out of said channels and contacting said inner surface of said cylindrical outer shell to uniformly cool said outer surface of said cylindrical outer shell, wherein said structural projections are solid non-helical and solid without holes or apertures.

2. A chill roll for cooling a web as recited in claim 1, wherein said cylindrical outer shell has a thickness in a range of about 0.025" to about 0.25".

3. A chill roll for cooling a web, as recited in claim 1, further comprising a plurality of spokes located on hubs disposed on said cylindrical inner shell, said spokes transporting coolant material to said outer surface of said cylindrical inner shell and said channels, and returning said coolant material from said channels and said outer surface of said cylindrical inner shell.

4. A chill roll for cooling a web, as recited in claim 3, wherein coolant intake spokes and coolant out-take spokes are arranged in alternating sequence.

5. A chill roll for cooling a web comprising a cylindrical outer shell having an inner surface and an outer surface, said inner surface of said outer shell having circumferential structural projections, spaced apart along a length of said cylindrical outer shell creating channels therebetween, said structural projections extending substantially orthogonally from said inner surface of said cylindrical outer shell so that portions of said inner surface of said cylindrical outer shell define a portion of said channels, wherein said structural projections are non-helical and circumferential and said structural projections are solid without holes or apertures, and wherein said outer surface of said cylindrical outer shell is smooth.

6. A chill roll as recited in claim 5, wherein said cylindrical outer roll has a thickness in a range of about 0.025 to about 0.25.

7. A chill roll for cooling a web, as recited in claim 5, wherein said outer surface of said cylindrical outer roll has a surface which is one of matte, gloss and a combination of matte and gloss.

8. A chill roll for cooling a web, as recited in claim 5, wherein said structural projections are spaced apart between about 0.05" to about 2".

9. A chill roll for cooling a web as recited in claim 5, wherein said cylindrical outer roll has a thickness in a range of about 0.025" to about 0.25".

10. A chill roll for cooling a web, comprising:

a) a cylindrical outer shell having an inner and an outer surface, said inner surface of said outer shell having non-helical and circumferential structural projections spaced along a length of said cylindrical outer shell creating channels therebetween, said structural projections extending substantially orthogonally from said inner surface of said cylindrical outer shell so that portions of said inner surface of said cylindrical outer shell define a portion of said channels; and b) a cylindrical inner shell having an inner and an outer surface, wherein a diameter of said inner shell is less than a diameter of said outer cylindrical shell, allowing a coolant material to flow into and out of said channels and contacting said inner surface of said cylindrical outer shell to uniformly cool said outer surface of said cylindrical outer shell, wherein said coolant material is introduced through and along an entire length of said cylindrical inner shell, and wherein said outer surface of said cylindrical outer shell is smooth.

11. A chill roll for cooling a web, as recited in claim 10, further comprising a plurality of spokes located on hubs disposed on said cylindrical inner shell, said spokes transporting coolant material to said outer surface of said cylindrical inner shell and said channels, and returning said coolant material from said channels and said outer surface of said cylindrical inner shell.

12. A chill roll for cooling a web, as recited in claim 11, wherein coolant intake spokes and coolant out-take spokes are arranged in alternating sequence.

13. A chill roll for cooling a web comprising a cylindrical outer shell having an inner surface and a smooth outer surface, said inner surface of said outer shell having structural projections, spaced apart along a length of said cylindrical outer shell creating channels therebetween, said structural projections extending substantially orthogonally from said inner surface of said cylindrical outer shell so that portions of said inner surface of said cylindrical outer shell define a portion of said channels, wherein said structural projections are non-helical and circumferential, and said coolant material is introduced through and along an entire length of said cylindrical inner shell.

14. A chill roll for cooling a web, as recited in claim 13, wherein said structural projections are spaced apart between about 0.05" to about 2".

15. A chill roll for cooling a web as recited in claim 13, wherein said cylindrical outer roll has a thickness in a range of about 0.025" to about 0.25".

* * * * *